US006185158B1

(12) United States Patent
Ito et al.

(10) Patent No.: US 6,185,158 B1
(45) Date of Patent: Feb. 6, 2001

(54) SMALL ELECTRONIC APPARATUS HAVING FUNCTION DISPLAY

(75) Inventors: Yukio Ito; Tomio Okigami; Isao Kitazawa, all of Tanashi (JP)

(73) Assignee: Citizen Watch Co., Ltd., Tokyo (JP)

( * ) Notice: Under 35 U.S.C. 154(b), the term of this patent shall be extended for 0 days.

(21) Appl. No.: 09/066,371

(22) PCT Filed: Aug. 29, 1997

(86) PCT No.: PCT/JP97/03035

§ 371 Date: Apr. 30, 1998

§ 102(e) Date: Apr. 30, 1998

(87) PCT Pub. No.: WO98/09200

PCT Pub. Date: Mar. 5, 1998

(30) Foreign Application Priority Data

Aug. 30, 1996 (JP) ..... 8-229610

(51) Int. Cl.[7] ..... G04B 19/20
(52) U.S. Cl. ..... 368/37; 368/28
(58) Field of Search ..... 368/28, 37, 38; 40/115

(56) References Cited

U.S. PATENT DOCUMENTS

| | | | | |
|---|---|---|---|---|
| 4,261,046 | * | 4/1981 | Ono et al. | 368/35 |
| 4,695,168 | * | 9/1987 | Meister et al. | 368/31 |
| 5,274,614 | * | 12/1993 | Yamazaki | 368/28 |
| 5,384,755 | * | 1/1995 | Ferenczy | 368/24 |
| 5,473,580 | * | 12/1995 | Gilomen | 368/28 |
| 5,956,294 | * | 9/1999 | Tatizawa et al. | 368/37 |

FOREIGN PATENT DOCUMENTS

| | | |
|---|---|---|
| 54-67470 | 5/1979 | (JP) . |
| 54-112677 | 9/1979 | (JP) . |
| 59-56185 | 3/1984 | (JP) . |
| 61-76978 | 4/1986 | (JP) . |
| 63-124683 | 8/1988 | (JP) . |
| 6-12987 | 2/1994 | (JP) . |
| 6-28780 | 4/1994 | (JP) . |

* cited by examiner

*Primary Examiner*—Bernard Roskoski
(74) *Attorney, Agent, or Firm*—Kanesaka & Takeuchi

(57) ABSTRACT

A small electronic apparatus provided with a functional display unit is formed of function driving device for generating function driving signals corresponding to a plurality of functions, a plurality of functional display devices corresponding to the functions and including first and second display devices, and a single motor electrically connected to the function driving devices and operated according to the function driving signals from the function driving device. A driving device transmits a driving force to the first functional display device, and an intermittent driving device is connected to the driving device to operate in association therewith. The intermittent driving device rotates the second display device intermittently. A clocking device is electrically connected to the function driving device. When a function of the first display device is completed, the clocking device sends a signal to reset the first display device to have a desired positional relation between the driving device and the intermittent driving device.

8 Claims, 5 Drawing Sheets

SMALL ELECTRONIC APPARATUS HAVING FUNCTION DISPLAY

FIELD OF THE INVENTION

This invention relates to a small electronic apparatus having a plurality of functional display means, and, more particularly, to an electronic device having a plurality of functional display means for displaying various types of times, dates, using a driving means such as a plurality of motors and display means such as hands and rotating plates.

DESCRIPTION OF THE BACKGROUND ART

In hand display type electronic watches which display time using hands, many multifunctional watches using a plurality of motors and possessing various functions as well as a time display function are conventionally manufactured as commercial products. Such a multifunctional watch is at present indispensable as one type of wrist watches. However, the wrist watch must have excellent portability and be compact, light, and inexpensive. Therefore, there is a certain limitation to the multifunctional provision of using a certain motor for a certain functional display.

There is a known structure disclosed in Japanese Patent Publication No. 41071/1976 for driving, each time as required, a date plate for displaying the date, which is one of the functions.

Japanese Patent Publication No. 41071/1976 discloses a structure in which, in the case of date feed only, the standard drive of constantly rotating hour and minute train wheels and the like is switched to a geneva system to drive the date plate and thereby achieve efficiently such a function as that of a date plate which is driven once a day.

In such a structure for driving the date plate in connection with motors for driving hour, minute, and second hands, however, a complex structure is required to convert the momentum for turning seconds equivalent to one day into the momentum for advancing the date by one day. This is unsuitable for the specifications of the watch. Therefore, the date plate is usually isolated from the motors for driving hour, minute, and second hands and is driven by a separate forced driving means.

A method in which the date plate is driven by an independent motor is a simple method for promoting multifunctionalization. This method requires a motor and train wheels used exclusively for the date plate, which causes further circuit complexity and increases the number of parts. Therefore, it is difficult to assemble a watch in a limited space giving rise to the problem wherein the watch is large or thick.

It is an object of the present invention to provide a functional display unit which can display many functions using a reduced number of motors thereby enabling a multifunctional display without making the electronic device large or thick, in small electronic apparatus such as timepieces possessing a plurality of display functions.

DISCLOSURE OF THE INVENTION

The above object can be attained by the provision of a functional display in a small electronic apparatus comprising:

- function driving means generating function driving signals corresponding to a plurality of functions;
- a plurality of functional display means which are so provided as to correspond to the plurality of functions; and

- a driving means which transmits driving forces to the functional display means simultaneously in accordance with the function driving signals from the function driving means.

In the embodiments, the plurality of functional display means comprises a first display means with sequentially varying display conditions in connection with the driving force from the driving means and a second display means with intermittently varying display conditions in connection with the driving force from the driving means; and the function driving means comprise a first function driving means for generating a functional driving signal by which only the first display means normally operates and the second function driving means by which only the second display means normally operates.

In the small electronic apparatus provided with the functional display unit of the present invention structured in this manner, a plurality of functional displays can be attained and a small electronic apparatus can be made more compact and thinner.

DETAILED DESCRIPTION OF THE INVENTION AND PREFERRED EMBODIMENT

The present invention will be explained in detail with reference to the appended drawings.

Figure 1:
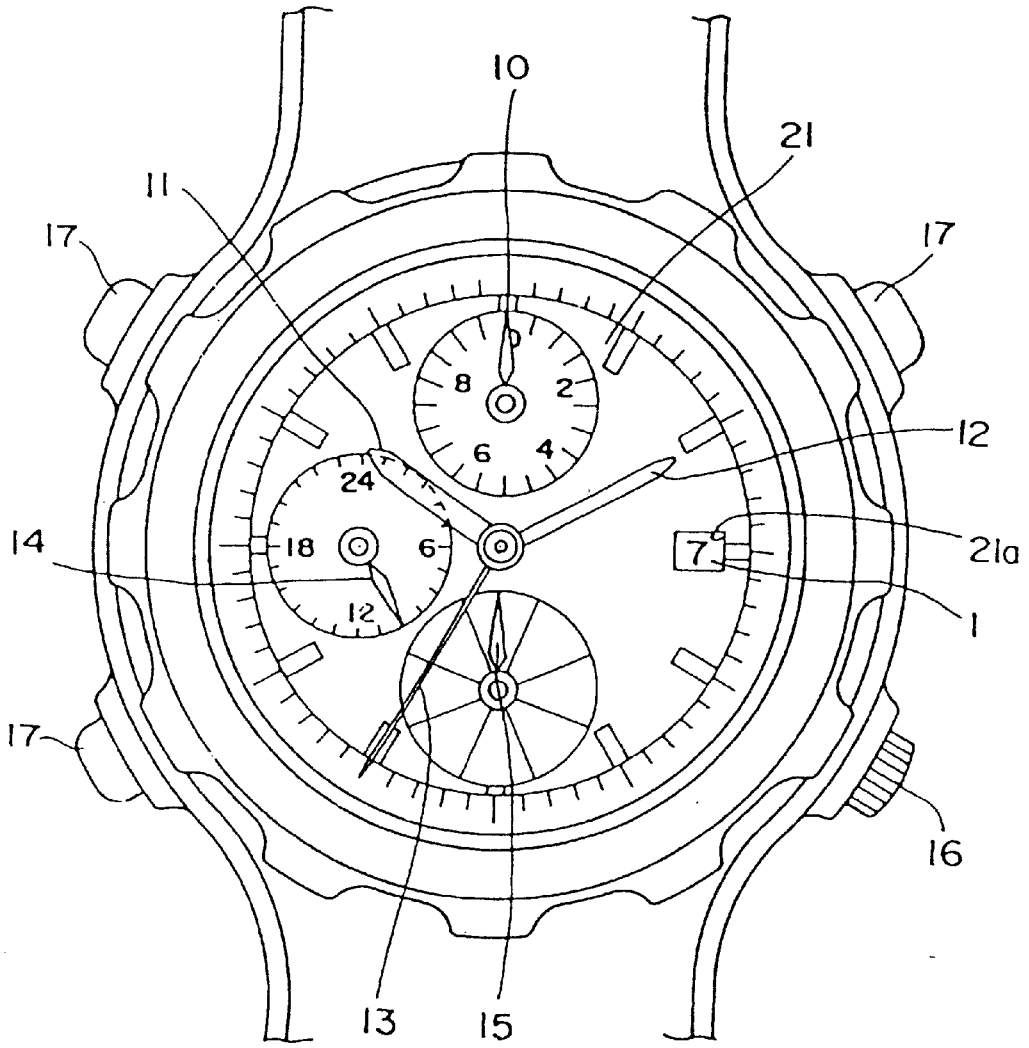
FIG. 1 is a top plan view of a wrist watch of the preferred embodiment corresponding to the present invention.
Figure 2:
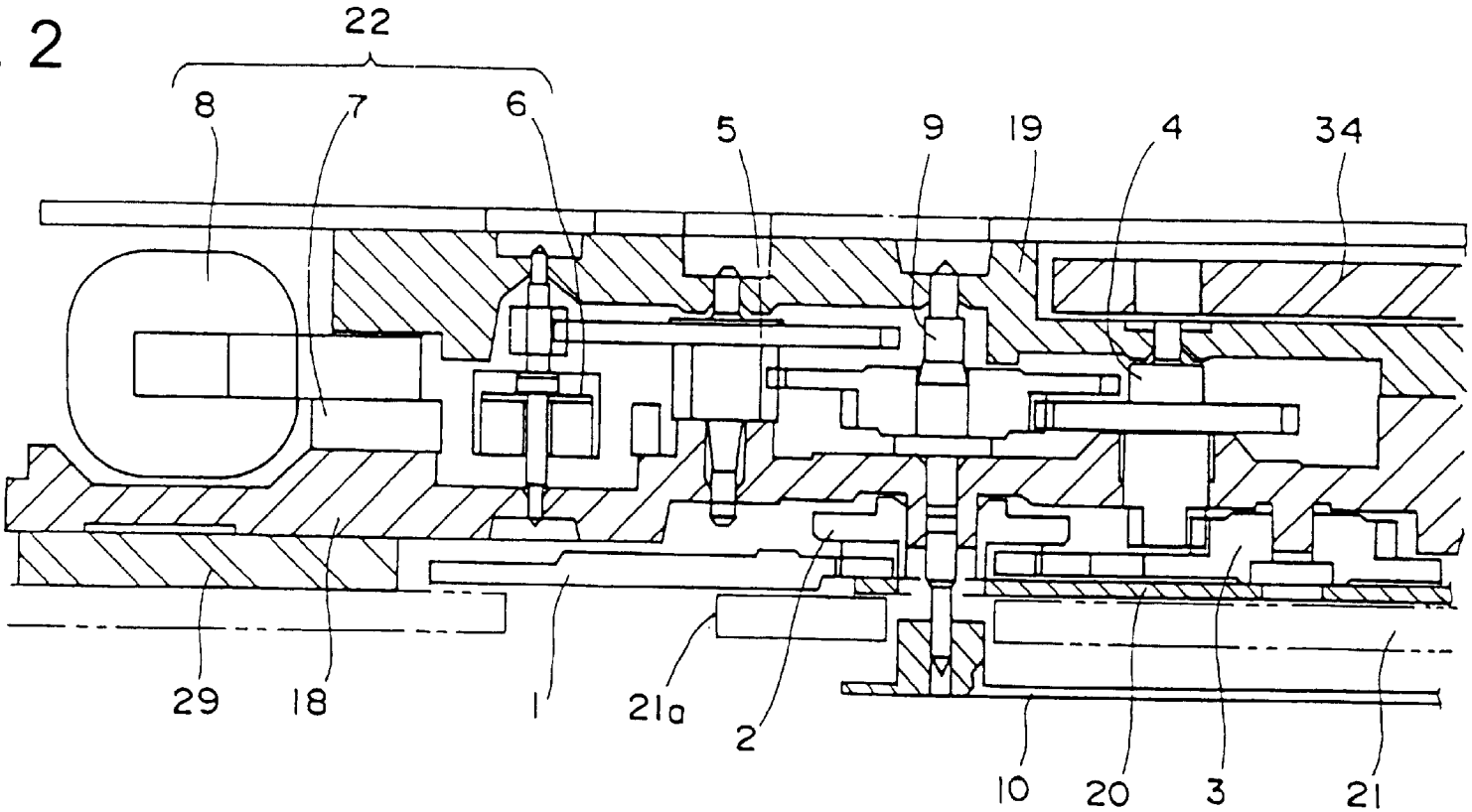
FIG. 2 is a partly sectional view showing the chrono-train wheels of the wrist watch.

FIG. 1 is a top plan view of an embodiment in which the small electronic apparatus of the present invention is applied to a hand display type electronic watch. FIG. 2 is a partly sectional view showing the chrono-train wheels which drive a chrono-hand in FIG. 1.

An hour hand 11 and a minute hand 12 for displaying time are disposed in the center of the hand display type electronic watch shown in FIGS. 1 and 2 and a second hand 13 is also disposed on the same axis. Further, a twenty four hour hand 14 which works in connection with the hour hand 11 is disposed in the direction of the nine o'clock position of the watch. Here, the hour hand 11, minute hand 12, and twenty four hour hand 14 are driven by an hour-minute motor described below and the second hand 13 is driven by an independent second motor described below.

A chrono-hand 10 is a first display means which displays another function differing from those of the hour, minute, second, and twenty four hour hands and is disposed in the direction of the twelve o'clock position of the watch. A date plate 1 for displaying the date is a second display means which is driven by the same driving means as that of the chrono-hand and exhibits intermittently varying display conditions in connection with the driving force from the driving means. The date plate 1 displays date by exposing a part from a date glass 21*a* opened in a dial 21.

A mode hand 15 for indicating a mode is disposed in the direction of the six o'clock position of the watch. The mode hand 15 indicates a mode switched by a crown 16 which is an external operating member. A push button 17 which is an external operating member is arranged for operating and amending hand positions in each mode, for example start or stop operations for the chronograph.

Figure 3:
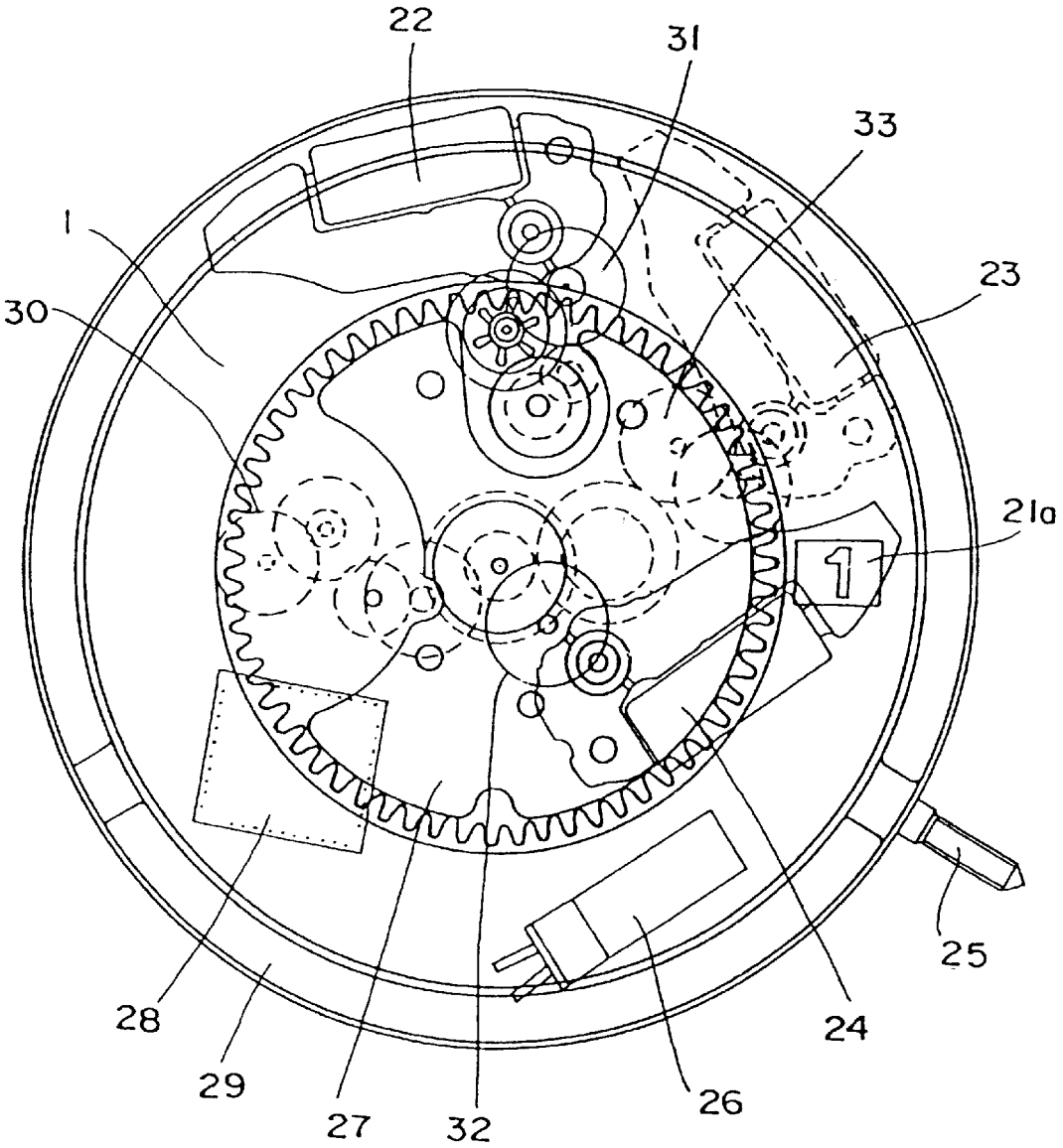
FIG. 3 is a top plan and perspective diagram of a movement of the wrist watch viewed from the side of a dial.

FIG. 3 is a top plan and perspective diagram of the hand display type electronic watch shown in FIG. 1, viewed from the side of the dial, showing the locations of each motor and a plurality of train wheels.

As shown in FIGS. 1 to 3, the chrono-hand 10 and the date plate 1 are driven by a chrono-motor 22 which is arranged separately from an hour-minute motor 23 and a second motor 24. The chrono-motor 22 is a driving means which is constituted of a rotor 6, a stator 7, and a coil 8. The chrono-hand 10 is attached to the top of a chronograph wheel 9 driven by a rotor 6 via a primary intermediate wheel 5 to display chrono-time and timer time. A date plate energy transfer wheel 3 and a date plate drive wheel 2 are driven in connection with the chronograph wheel 9 via an auxiliary intermediate wheel 4 to drive the date plate 1 and thereby to display the date.

The rotor 6, primary intermediate wheel 5, chronograph wheel 9, and auxiliary intermediate wheel 4 are supported on the axes by a main plate 18 and a train wheel bridge 19. The date plate energy transfer wheel 3 and the date plate drive wheel 2 are supported on the axes by the main plate 18 and a date plate holder 20 for holding a back plate 27 though not shown and the date plate 1. In a dial 21, the date glass 21*a* for displaying the date and other glasses for allowing insertion of each hand are opened. A dial support plate 29 is installed between the dial 21 and the main plate 18 as a spacer for preventing the date plate 1 from adhering to the dial 21.

As shown in FIG. 3, the date plate 1 has a disk form. Patterns for indicating date are formed by printing or the like on the surface of the date plate 1. The date plate 1 is driven by the chrono-motor 22 via a chrono-train wheel 31. An internal gear 1*a* of the date plate 1 is guided by the periphery of the back plate 27 to rotate and indicate date by exposing a part of the patterns from the date glass 21*a* which is an opening for the dial 21.

The hour-minute motor 23 drives the hour hand 11 and the minute hand 12 via an hour-minute train wheel 33 to display the hours and the minutes and drives the twenty four hour hand 14 via a twenty four hour wheel 30 to display the twenty four hour time. The second motor 24 drives the second hand 13 via a second train wheel 32, which is driven separately from the hour-minute train wheel 33, to display the seconds.

A dial support plate 29 is disposed like a ring on the periphery of the date plate 1. Also, though not described in detail, a watch circuit 34 constituted of circuit parts, such as a crystal oscillator 26, and an IC 28 transmits driving signals and the like to each motor. A winding stem 25 conveys to a watch movement the action of the crown 16 operated by an external operation.

Figure 4:
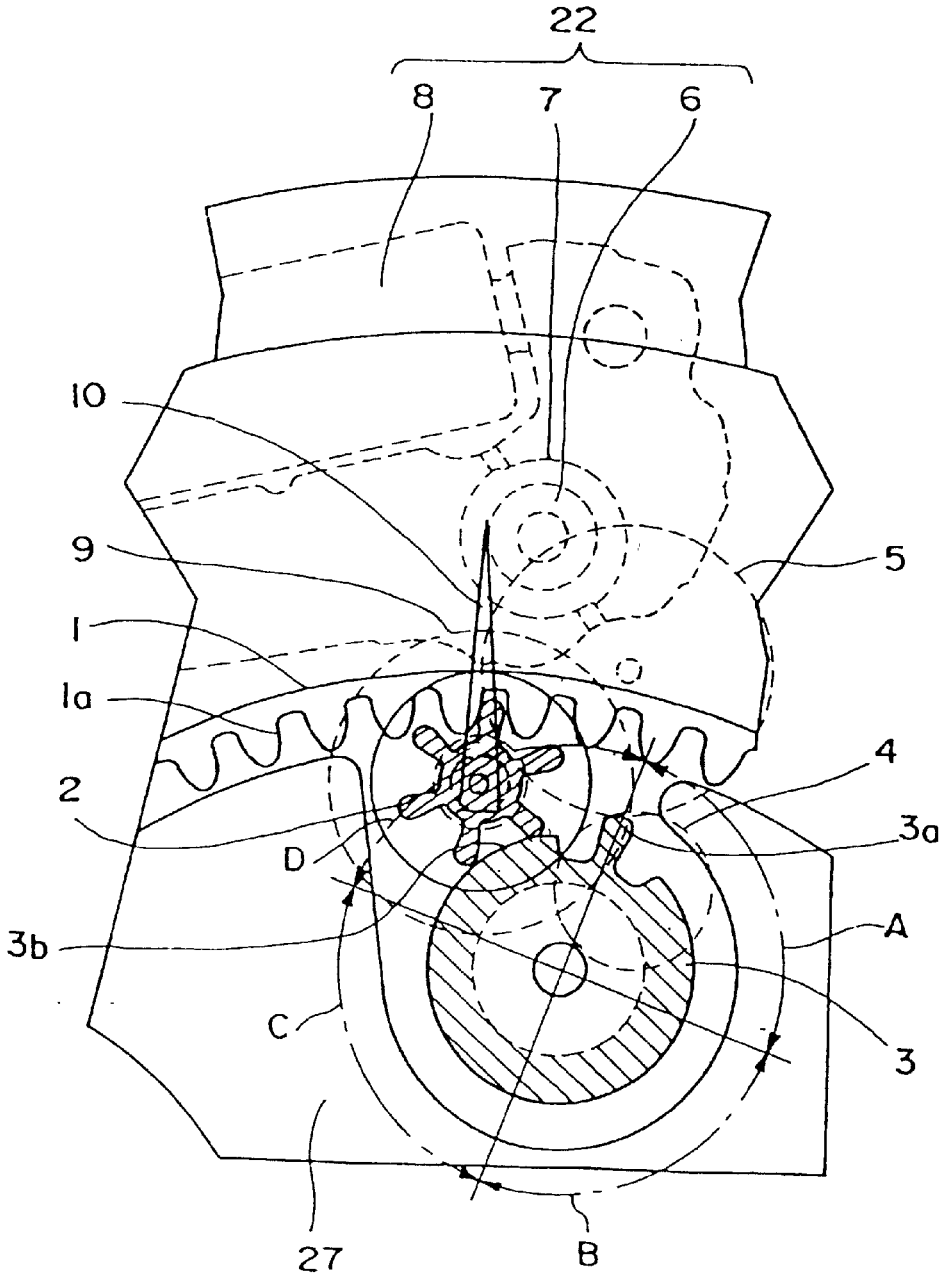
FIG. 4 is an enlarged top plan view of a working portion of a date plate in FIG. 3.

FIG. 4 is an enlarged top plan view of FIG. 3 showing an operating portion of the date plate.

As shown in FIGS. 2 and 4, the chrono-motor 22 constituted of the rotor 6, stator 7, and coil 8 rotates the chronograph wheel 9 via the primary intermediate wheel 5, thereby rotating the chrono-hand 10 to indicate the chrono-time. At this time, driving force is further transferred to the date plate energy transfer wheel 3 from the chronograph wheel 9 via the auxiliary intermediate wheel 4. The date plate energy transfer wheel 3 is provided with one pawl 3*a* which engages with and turns the date plate drive wheel 2. The arc periphery except for the pawl 3*a* forms a stopper 3*b* which is interposed between gear teeth to lock the rotation of the date plate drive wheel 2. Specifically, the date plate energy transfer wheel 3 and the date plate drive wheel 2 which have such a structure are combined to form a geneva mechanism thereby intermittently driving the date plate 1.

The number of gear teeth is designed so that the chronograph wheel 9 turns once every 60 steps of the chronograph motor 22. The chronograph wheel 9 rotates according to driving signals from the watch circuit 34 to indicate each display of the functional hands for a chronograph minute display and one-twentieth second display and for a timer minute display.

Also, in the date plate energy transfer wheel 3 which is driven by the chronograph wheel 9 via the auxiliary intermediate wheel 4, the number of gear teeth is designed so that the date plate energy transfer wheel 3 turns once every four rotations of the chronograph wheel 9. During the first rotation of the chronograph wheel 9, the pawl 3*a* moves forward within a zone A. Similarly, the pawl 3*a* moves forward within a zone B, zone C, and zone D during the second, third, and fourth rotations respectively.

The system structure of the embodiment according to the present invention is now explained with reference to a block diagram of FIG. 5.

For the sake of simplicity, the explanations will be limited to the parts having great significance in the present invention, specifically, the drive system for the chrono-hand 10 and for the date plate 1. Explanations for other drive systems will be omitted.

Figure 5:
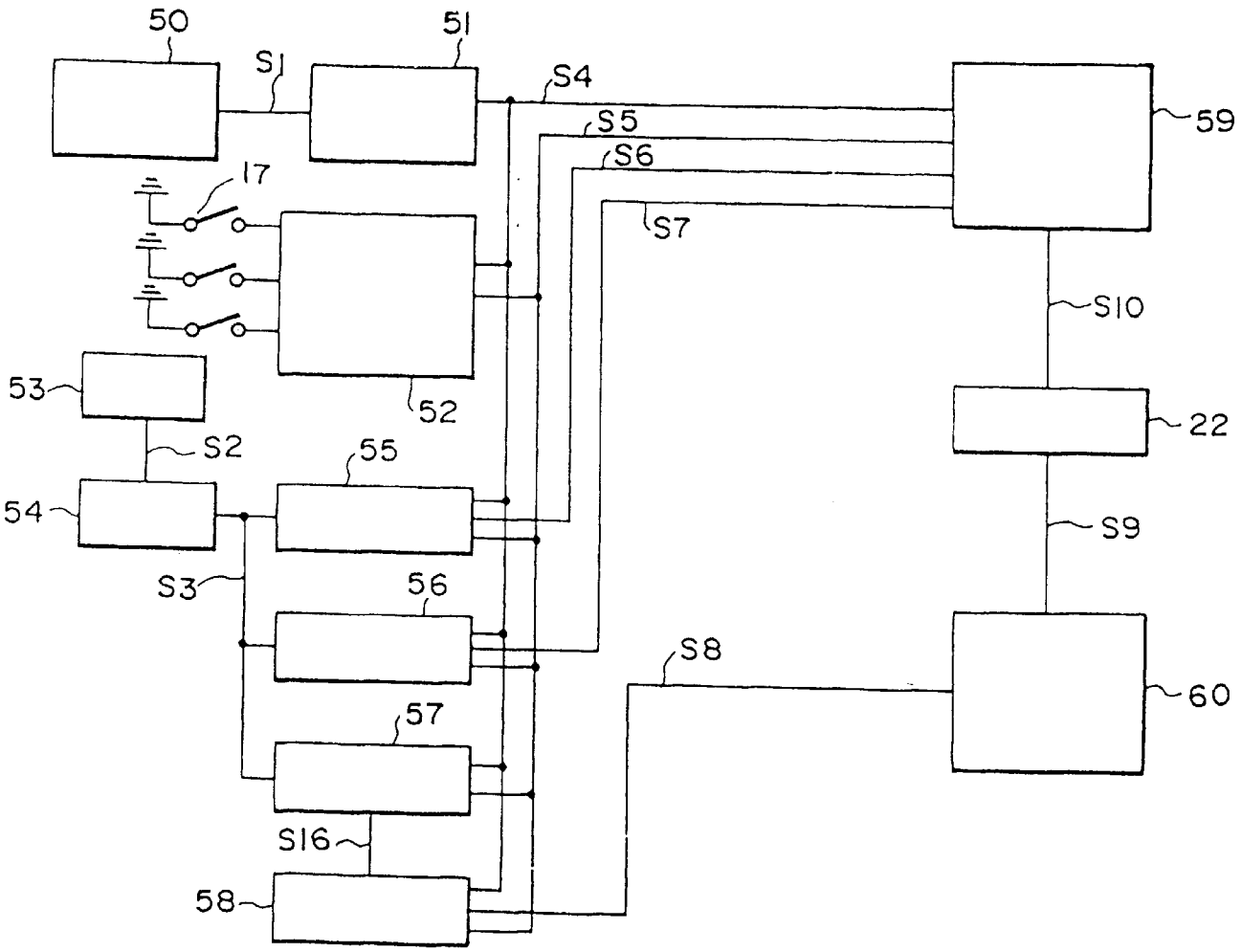
FIG. 5 is a block diagram showing the system structure of the wrist watch.

In FIG. 5, a mode switch 50 outputs mode switch data S1 which indicates the connecting condition of the mode switch. The mode signal generating means 51 receives the mode switch data S1 output from the mode switch 50 and detects the present mode of the multifunctional watch to output mode data S4. The mode internal condition generating means 52 detects each condition in the mode from the connecting condition of the push button 17 and the mode data S4 to output mode internal condition data S5. The mode data S4 and the mode internal condition data S5 are used for the following various controls.

An oscillating means 53 outputs a reference signal S2 for a time check. A dividing means 54 divides the reference signal S2 output from the oscillating means 53 to output a dividing signal S3. A chrono-clocking means 55, a timer clocking means 56, and a watch clocking means 57 receive the dividing signal S3 to check respective times. A calendar means 58 receives an update signal S16 when the watch clocking means 57 overflows and outputs date data S8 to update the calendar.

A chrono-hand driving means 59 as a first function driving means receives the mode data S4, mode internal condition data S5, chrono-minute data S6, and timer minute data S7 to output to the chrono-motor 22 a chrono-hand driving signal S10 for continuously driving the chrono-hand 10. A date plate driving means 60 as the second function driving means receives the date data S8 to output to the chrono-motor 22 a date plate driving signal S9 as the second function driving signal for driving the date plate 1 as the second display means.

Next, the action of the hand display type electronic watch is now explained with reference to FIGS. 4 and 5.

In the condition shown in FIG. 4, the chrono-hand 10 indicates a zero (0) position, e.g. a prescribed display condition. In the condition where the chrono-minute drive operation is started in a chrono-mode, the chronograph wheel 9 makes one rotation based on the count of 60 minutes. The pawl 3*a* of the date plate energy transfer wheel 3 of the geneva mechanism constituted of the date plate energy transfer wheel 3 and the date plate drive wheel 2 moves from the zone A to the zone B. The pawl 3*a* of the date plate energy transfer wheel 3 does not yet reach the zone D where the date plate drive wheel 2 is allowed to rotate. The stopper 3*b* which locks the rotation of the date plate drive wheel 2 still remains engaged. The date plate drive wheel 2 does not rotate and hence the date plate 1 does not also rotate.

When the chrono-minute display for 60 minutes is finished, the chrono-hand driving means 59, which receives the mode internal condition data S5 requesting "reset" from the chrono-clocking means 55, outputs a reverse drive pulse to drive the chrono-hand 10 in reverse. The chrono-hand 10 is returned to the 0 position (prescribed display condition) by the reverse drive and the pawl 3*a* of the date plate energy transfer wheel 3 returns to the zone A and remains there. Specifically, the chrono-hand driving means 59 generates a driving signal S10 for driving the chrono-motor 22 only during suspended periods of time, in which the date plate 1 stops operating, between the intermittent actions and allows the chrono-hand 10 to return to the prescribed display condition at the termination of the chrono-minute display.

Similarly, in the case where the mode is a timer mode and a timer time for 59 minutes is set by the timer-clocking means 56, the pawl 3*a* of the date plate energy transfer wheel 3 never exits the zone A even if the chronograph wheel 9 turns to the position set for the timer. After 59 minutes has elapsed, the chronograph wheel 9 returns to the time-up condition (0 position), which is the prescribed condition by reverse drive, and the pawl 3*a* of the date plate energy transfer wheel 3 returns to the start position of the zone A and remains there.

Next, when the time passes 0 a.m. and the date is changed, the chrono-hand 10 starts to operate and the chronograph wheel 9 makes four revolutions so that the pawl 3*a* of the date plate energy transfer wheel 3 makes one rotation from the zone A to the zone A via the zones B, C, and D. At this time, the pawl 3*a* of the date plate energy transfer wheel 3 crosses the zone D where it causes the date plate drive wheel 2 to rotate. The stopper 3*b* which locks the rotation of the date plate drive wheel 2 is unlocked from the position between the gear teeth of the date plate drive wheel 2. The pawl 3*a* of the date plate energy transfer wheel 3 turns the date plate drive wheel 2 in a distance of two gear teeth. When the date plate drive wheel 2 rotates for is rotated the distance of two gear teeth, the stopper 3*b* is interposed between the gear teeth of the date plate drive wheel 2 and remains there. Consequently, the date plate 1 is turned and fed the distance of two gear teeth by the date plate drive wheel 2 thereby changing the date. The chrono-hand 10 returns to the prescribed condition (original 0 position) after the chronograph wheel 9 makes four revolutions.

When omitting the 31st day and feeding the date two days in an end of a month with thirty or less days, the chronograph wheel 9 makes eight revolutions so that the pawl 3*a* of the date plate energy transfer wheel 3 makes two revolutions. In the case of driving in the direction to set back the date, for example, at the time of amending the date, the chronograph wheel 9 is allowed to turn four times in the reverse direction. The pawl 3*a* of the date plate energy transfer wheel 3 moves from the zone D to the zone A via the zones C and B in this order to reversely drive the date plate drive wheel 2 thereby reversely driving the date plate 1 to set back the date one day.

With respect to the action of the system in the embodiment of the present invention, the case of displaying chrono-time will be first explained.

It is assumed for the sake of simplicity that the chronograph is in a reset condition and the chrono-hand 10 is set at the 0 position.

First, the mode switch 50 is set to a chronograph mode whereby the mode signal generating means 51 outputs mode data S4 indicating "chrono-mode". In this condition, mode internal condition data S5 indicating "chrono-run" is output by pushing the push button 17. The chrono-clocking means 55 receives the mode data S4 and the mode internal condition data S5 to start chrono-clocking. Then, chrono-minute data S6 is updated every time a chrono-minute digit is carried.

The chrono-hand driving means 59 which has received the chrono-minute data S6 calculates the necessary number of motor drive pulses to output a chrono-hand driving signal S10. Since the chrono-hand 10 may be carried by one step every minute in the normal direction during the chrono-run, one motor drive pulse is output as the chrono-hand driving signal S10 every carriage to a minute digit. The chrono-clocking is permitted only during suspended periods of time, in which the date plate stops operating, between intermittent actions.

In the reset action after the clocking is terminated, the mode internal condition generating means 52 outputs mode internal condition data indicating "reset" on pushing the push button 17. The chrono-clocking means 55 receives this data to stop clocking and to reset the count to 0. The chronominute data S6 is set to 0, whereby the chrono-hand 10 returns to the 0 position. Since chrono-clocking is permitted only during suspended periods of time, in which the date plate stops operating, between intermittent actions, it is necessary to set back by chrono-clocked counts by reverse drive to return to the 0 position without impairing the relation between the date plate 1 and the chrono-hand 10. For example, in the case of being reset when 33 minutes are clocked, 33 reverse drive pulses are output as the chrono-hand driving signal S10. Consequently, the chrono-hand 10 returns to the 0 position by reverse rotation.

Next, the action of the system when feeding the date is now explained.

The date plate driving means 60 which has received the date data S8 for update calculates the number of drive pulses of the chrono-motor 22 required to drive the date plate based on the date data S8.

When the date is fed in a reset condition in which the chronograph is not used, 240 drive pulses are output as the chrono-hand driving signal S10. After the chrono-hand makes four revolutions, the date plate 1 gains one day whereas the chrono-hand 10 stops at the same 0 position as that before the date feed after making four revolutions.

When the date feed is performed during the chrono-run, the chrono-hand 10 must return to the prescribed display condition, e.g. chrono-time display before feeding the date. Because of this, the number of drive pulses is 240 which is calculated by multiplying 4 (revolutions) by 60 (steps).

As a result, 240 drive pulses as the date plate driving signal S9 are output in a group from the date plate driving means 60. When omitting the 31st day and feeding the date two days at an end of a month with thirty or less days, the number of drive pulses is 480.

When the time of date feed comes during the chrono-run, the date driving signal S9 is output in the intervals between the times when the chrono-hand driving signal S10 is output every minute from the chrono-hand driving means 59. At this time, the chrono-hand 10 makes four revolutions to drive the date plate 1. Since 240 drive pulses corresponding to four revolutions are output, the position of the chrono-hand 10 for indicating the chrono-time does not change from the position before the date feed even after the date feed has been completed. There is no occasion when chrono-time display malfunctions.

The action in the case of the timer clocking is the same as in the case of the chrono-clocking. It is noted that in character this timer clocking starts from the initialized time and the drive direction of the hand is opposite to that in the chrono-clocking.

In the present embodiment, the pawl 3*a* of the date plate energy transfer wheel 3 is designed to be positioned in four zones. If the chronograph wheel 9 is designed to operate in the range where the date plate is never carried, the same effect can be obtained. Therefore, two or more divided zones may be designed.

Also, with the above-explained driving means used for the function of displaying the date among a plurality of functional display means in the present embodiment, the display conditions are varied intermittently in connection with the driving force by means of a geneva mechanism. However, a structure may be adopted in which the display conditions vary sequentially (continuously) in connection with the driving force by means of a driving means including train wheels of gears in place of the geneva mechanism, whereby a plurality of functional displays can be also achieved. Specifically, even if the chrono-hand 10 starts operating and the date plate 1 starts operating during the performance of the chronograph function, the display position of the date plate 1 returns to the prescribed date to attain its function, if the chrono-hand 10 returns to the prescribed display condition after the termination of the chronograph function.

Also, in the function of displaying the date among a plurality of functional display means in the present embodiment, the display conditions are varied intermittently in connection with the driving force by means of a geneva mechanism. Display functions using a rotating plate such as a day dial for displaying days, and a month dial for displaying months, can be structured in the same manner. Various display functions such as a timer function using hands as well as the chronograph functions can be applied as the functional display means in which the display conditions vary sequentially (continuously) in connection with the driving force from a driving means.

Specifically, various functions such as a chronograph, timer, date, days, months, and the like are the subjects of the plurality of functions which can be displayed in the present invention.

INDUSTRIAL APPLICABILITY OF THE INVENTION

As is clear from the above explanations, a small electronic apparatus provided with the functional display unit according to the present invention is suitable for electronic devices which are required to display various functions in a pager, portable telephone, and health care instruments such as a passometer, hemodynameter, and the like as well as in an electronic wrist watch.

What is claimed is:

1. A small electronic apparatus provided with a functional display unit comprising:

function driving means generating function driving signals corresponding to a plurality of functions;

a plurality of functional display means provided so as to correspond to the functions and including first and second display means;

a single motor electrically connected to the function driving means and operated according to the function driving signals from the function driving means;

driving means which transmits a driving force to the first display means from the single motor;

intermittent driving means connected to the driving means to operate in association therewith, said intermittent driving means rotating the second display means intermittently; and clocking means electrically connected to the function driving means, said clocking means, when a function of the first display means is completed, sending a signal to reset the first display means to have a desired positional relation between the driving means and the intermittent driving means.

2. The small electronic apparatus provided with a functional display unit according to claim 1, wherein the intermittent driving means is intermittently driven by means of a geneva mechanism.

3. The small electronic apparatus provided with a functional display unit according to claim 1, wherein the function driving means generates a function driving signal for driving only at least one display means.

4. The small electronic apparatus provided with a functional display unit according to claim 1, wherein the function driving means returns to a prescribed display condition the second display means which was driven in connection with the first display means.

5. The small electronic apparatus provided with a functional display unit according to claim 1, wherein the first and second display means are time lapse display means and calendar display means.

6. The small electronic apparatus provided with a functional display unit according to claim 1, wherein said clocking means resets the first display means to an original position before operation thereof.

7. The small electronic apparatus provided with a functional display unit according to claim 1, wherein said driving means operates the intermittent driving means so that the second display means is actuated after a completion of the first display means.

8. The small electronic apparatus provided with a functional display unit according to claim 7, wherein said first display means includes a hand, said second display means being actuated after the hand rotates more than 360 degrees.

* * * * *